US007963121B2

(12) United States Patent
Ishida et al.

(10) Patent No.: US 7,963,121 B2
(45) Date of Patent: Jun. 21, 2011

(54) OUTDOOR UNIT OF AIR CONDITIONER

(75) Inventors: Keiji Ishida, Sakai (JP); Tadashi Sao, Sakai (JP); Ikuji Ishii, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 552 days.

(21) Appl. No.: 12/091,121

(22) PCT Filed: Oct. 27, 2006

(86) PCT No.: PCT/JP2006/321519

§ 371 (c)(1),
(2), (4) Date: Apr. 22, 2008

(87) PCT Pub. No.: WO2007/052559

PCT Pub. Date: May 10, 2007

(65) Prior Publication Data

US 2009/0114376 A1 May 7, 2009

(30) Foreign Application Priority Data

Nov. 1, 2005 (JP) ..... 2005-318921
Feb. 28, 2006 (JP) ..... 2006-053138

(51) Int. Cl.
*F25B 39/04* (2006.01)

(52) U.S. Cl. ..... 62/507; 62/428

(58) Field of Classification Search ..... 62/507
See application file for complete search history.

(56) References Cited

U.S. PATENT DOCUMENTS 6,289,974 B1 * 9/2001 DeGregoria et al. ..... 165/8

FOREIGN PATENT DOCUMENTS

| | | | |
|---|---|---|---|
| JP | 55-44124 | U | 9/1978 |
| JP | 11-023009 | A | 1/1999 |
| JP | 2004-37007 | A | 2/2004 |
| JP | 2004-211931 | A | 7/2004 |
| JP | 2005-120926 | A | 5/2005 |

* cited by examiner

*Primary Examiner* — Frantz F Jules
*Assistant Examiner* — Lukas Baldridge
(74) *Attorney, Agent, or Firm* — Global IP Counselors

(57) ABSTRACT

An outdoor unit of an air conditioner is provided in which a wind whistling sound and a vibration noise due to airflow are reduced. The outdoor unit includes an outdoor heat exchanger, a fan, a motor for driving the fan, and a motor support table for supporting the motor. The fan moves air on the outdoor heat exchanger to promote heat exchange between refrigerant and air. The motor support table (63) is provided with a rectifying member, and the rectifying member deflects air flowing toward the motor support table in a predetermined direction.

5 Claims, 7 Drawing Sheets

OUTDOOR UNIT OF AIR CONDITIONER

CROSS-REFERENCE TO RELATED APPLICATIONS

This U.S. National stage application claims priority under 35 U.S.C. §119(a) to Japanese Patent Application Nos. 2005-318921, filed in Japan on Nov. 1, 2005, and 2006-053138, filed in Japan on Feb. 28, 2006, the entire contents of which are hereby incorporated herein by reference.

TECHNICAL FIELD

The present invention relates to an outdoor unit of an air conditioner. More specifically, the present invention relates to an outdoor unit of an air conditioner in which a motor that drives a fan is disposed on the upstream side of airflow against the fan.

BACKGROUND ART

As an air conditioner, there is a so-called multi-type air conditioner for a building, in which a plurality of indoor units are connected to one or a plurality of outdoor units. With this type of air conditioner, the outdoor unit is generally disposed on a roof of a building, and a refrigerant circuit is formed such that refrigerant can circulate between the outdoor unit and the indoor unit disposed in each room of the building.

The outdoor unit of the conventional air conditioner has a rectangular parallelepiped shaped case, and a heat exchanger, a compressor, and other components are disposed in this case. Further, a fan and a motor for driving the fan are disposed at the upper portion of the case.

The motor of this type of outdoor unit is disposed on the upstream side of airflow against the fan, with the motor fixed to a motor support table (for example, see Japanese Patent Application Publication No. 2004-37007).

SUMMARY OF THE INVENTION

Object to be Achieved by the Invention

With the conventional outdoor unit, the cross-section of the motor support table is formed in an angular U-shape to ensure rigidity, so that a motor, which is a heavy object, is fixed to the support table. Because the lower surface of the motor support table faces the direction of airflow in a substantially orthogonal direction, the lower surface becomes a resistance to the airflow, generating wind whistling sound and vibration noise. When the motor rotation speed is decreased, the air volume will be reduced and the wind whistling sound and vibration noise will also be reduced. However, the performance of the air conditioner will be reduced as well.

An object of the present invention is to provide an outdoor unit of an air conditioner in which a noise generated due to airflow and the motor support table is reduced.

Means to Achieve the Object

An outdoor unit of an air conditioner according to a first aspect of the present invention includes an outdoor heat exchanger, a fan, a motor for driving the fan, and a motor support table for supporting the motor. The fan moves air on the outdoor heat exchanger and promotes heat exchange between refrigerant and air. The motor support table is provided with a rectifying member, and this rectifying member deflects air flowing toward the motor support table in a predetermined direction.

With this outdoor unit, the rising airflow that has passed through the outdoor heat exchanger is deflected by the rectifying member, and the airflow flows avoiding the motor support table. Accordingly, the airflow does not directly hit the motor support table. Thus, the resistance against the airflow is reduced and the wind whistling sound is also reduced. As a result, it is possible to increase the fan rotation speed compared to the case where the rectifying member is not provided, and the performance of the air conditioner improves because of an increase in the air volume.

An outdoor unit of an air conditioner according to a second aspect of the present invention is the outdoor unit of an air conditioner according to the first aspect of the present invention, wherein the rectifying member includes a deflecting portion. With this deflecting portion, the area where the airflow reflects on a surface orthogonal to the direction of the airflow from the upstream side to the downstream side gradually increases in the direction of the airflow from the upstream side to the downstream side.

Here, the airflow is gradually deflected by the deflecting portion, the resistance of the motor support table against the airflow is reduced, and the wind whistling sound at the time when the airflow passes through the motor support table is reduced.

An outdoor unit of an air conditioner according to a third aspect of the present invention is the outdoor unit of an air conditioner according to the second aspect of the present invention, wherein the cross-sectional shape of the deflecting portion is triangular.

Here, the airflow is gradually deflected by the deflecting portion whose cross-sectional shape is triangular. The resistance of the motor support table against the airflow is reduced, and the wind whistling sound at the time when the airflow passes through the motor support table is reduced.

An outdoor unit of an air conditioner according to a fourth aspect of the present invention is the outdoor unit of an air conditioner according to any one of the first through third aspects of the present invention, wherein the rectifying member includes a guide portion. The guide portion extends from an end portion of the deflecting portion on the downstream side of the airflow in a direction substantially parallel to the rotation axis of the motor.

Here, the airflow deflected by the deflecting portion is guided by the guide portion back in the direction in which the airflow was flowing before being deflected. Accordingly, the directions of the airflow flowing into the fan are integrated substantially in the same direction. Therefore, the interference noise between the fan and the airflow becomes more monotonous than when the directions of the airflow flowing into the fan are not integrated, and thus the generation of abnormal noise is suppressed.

An outdoor unit of an air conditioner according to a fifth aspect of the present invention includes a heat exchanger, a fan, a motor for driving the fan, and a motor support table for supporting the motor. The fan moves air on the heat exchanger and promotes heat exchange between refrigerant and air. The motor support table is provided with a rectifying member, and this rectifying member deflects the air flowing toward the motor support table in a predetermined direction. The motor support table is formed such that the cross-sectional shape thereof is an angular U-shape, and the motor support table has an opening opened in one direction. The rectifying member includes a deflecting portion and a guide portion. With this deflecting portion, the area where the airflow reflects on a surface orthogonal to the direction of the airflow from the upstream side to the downstream side gradually increases in the direction of the airflow from the upstream side to the downstream side. The guide portion extends from an end portion of the deflecting portion on the downstream side of the airflow in a direction substantially parallel to the rotation axis of the motor. In addition, the guide portion faces against the opening of the motor support table.

Here, the airflow is gradually deflected by the deflecting portion, and thus the airflow flows avoiding the motor support table. Accordingly, the resistance of the motor support table against the airflow is reduced, and the wind whistling sound at the time when the airflow passes through the motor support table is reduced. Further, because the guide portion covers the opening of the motor support table, an airflow vortex in the opening is decreased, resulting in reduction in vibration noise due to the airflow vortex.

An outdoor unit of an air conditioner according to a sixth aspect of the present invention is the outdoor unit of an air conditioner according to the fifth aspect of the present invention, wherein a sealing member is provided in a gap between the motor support table and the rectifying member so as to suppress air from passing therethrough.

Here, the inter-component gap that is generated when the rectifying member is mounted to the motor support table is covered by the sealing member, resulting in suppressing air from flowing in from the gap, or blocking flowed-in air on the way. Accordingly, hardly any air passes through the gap, and the generation of the wind whistling sound is reduced.

An outdoor unit of an air conditioner according to a seventh aspect of the present invention is the outdoor unit of an air conditioner according to the sixth aspect of the present invention, wherein the sealing member is compressed when the motor support table and the rectifying member are mounted.

Here, for example, the sealing member having a thickness dimension larger than the gap between the motor support table and the rectifying member is adhered, in advance, to a spot where the gap is created. By so doing, the sealing member is compressed when the motor support table and the rectifying member are tightened with a screw, and the sealing member is adhered to both of the motor support table and the rectifying member. Accordingly, incomplete sealing spots are substantially eliminated, suppressing the entrance of the airflow and reducing the generation of the wind whistling sound.

Effects of the Invention

With the outdoor unit of an air conditioner according to the first through third aspects of the present invention, the airflow does not directly hit the motor support table. Thus, the resistance against the airflow is reduced and the wind whistling sound is also reduced.

With the outdoor unit of an air conditioner according to the fourth aspect of the present invention, the directions of the airflow flowing into the fan are integrated substantially in the same direction. Therefore, the interference noise between the fan and the airflow becomes more monotonous than when the directions of the airflow flowing into the fan are not integrated, and thus the generation of abnormal noise is suppressed.

With the outdoor unit of an air conditioner according to the fifth aspect of the present invention, the resistance against the airflow is reduced, and the wind whistling sound is reduced. In addition, vibration of the motor support table due to an airflow vortex is suppressed, and the noise is reduced.

With the outdoor unit of an air conditioner according to the sixth and seventh aspects of the present invention, the sealing member is adhered to both of the motor support table and the rectifying member, resulting in suppressing entrance of the airflow and reducing the generation of the wind whistling sound.

DETAILED DESCRIPTION OF THE INVENTION

First Embodiment

<Structure of Air Conditioner>

Figure 1:
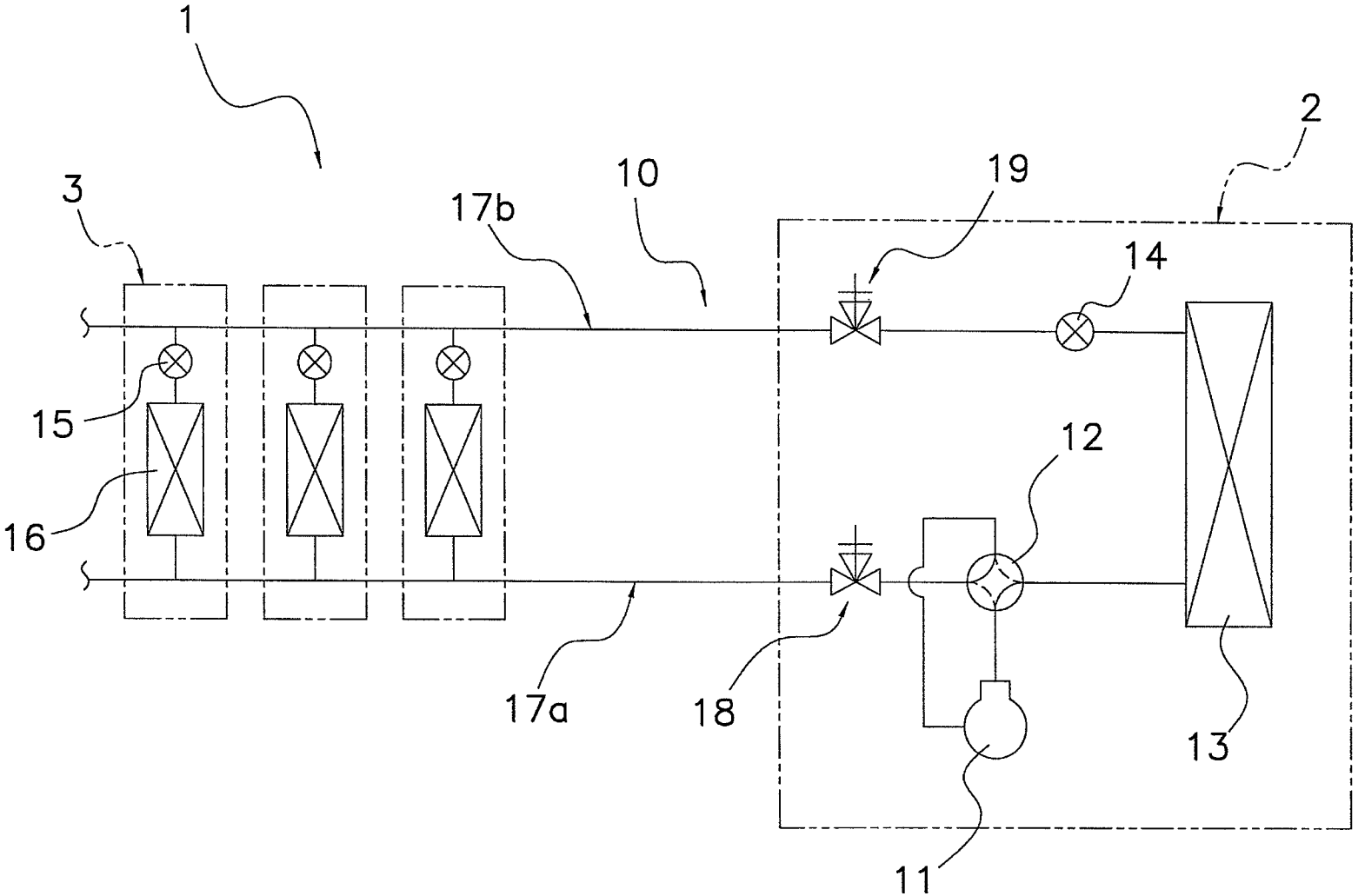
FIG. 1 is a refrigerant circuit diagram of an air conditioner including an outdoor unit according to an embodiment of the present invention.

FIG. 1 shows a refrigerant circuit of an air conditioner including an outdoor unit according to a first embodiment of the present invention. The air conditioner 1 is a multi-type air conditioner for a building, in which a plurality of indoor units 3 are connected in parallel to one or a plurality of outdoor units 2 and a refrigerant circuit 10 is formed to allow refrigerant to circulate.

A compressor 11, a four way switching valve 12, an outdoor heat exchanger 13, and an outdoor expansion valve 14 are included in the outdoor unit 2, and an indoor expansion valve 15 and an indoor heat exchanger 16 are included in the indoor unit 3. In addition, the four way switching valve 12 and the indoor heat exchanger 16 are interconnected by a gas-side refrigerant communication pipe 17*a*, and the outdoor expansion valve 14 and the indoor expansion valve 15 are interconnected by a liquid-side refrigerant communication pipe 17*b*. A gas-side shut-off valve 18 and a liquid-side shut-off valve 19 are disposed at a terminal portion of the refrigerant circuit inside the outdoor units 2. The gas-side shut-off valve 18 is disposed on the four way switching valve 12 side, and the liquid-side shut-off valve 19 is disposed on the outdoor expansion valve 14 side. The gas-side refrigerant communication pipe 17*a* is connected to the gas-side shut-off valve 18, and the liquid-side refrigerant communication pipe 17*b* is connected to the liquid-side shut-off valve 19.

Note that, as for the actual compressor 11, a capacity-variable inverter compressor whose rotation speed is controlled by the inverter and a constant capacity compressor having a constant capacity which is on-off controlled are often used in combination.

<Operation of Air Conditioner>

Next, the operation of the air conditioner 1 is described.

First, during cooling operation, the four way switching valve 12 is held in a state shown by solid lines in FIG. 1. A high-temperature high-pressure gas refrigerant discharged from the compressor 11 flows into the outdoor heat exchanger 13 via the four way switching valve 12, exchanges heat with the outdoor air, and becomes condensed/liquefied. The liquefied refrigerant passes through the outdoor expansion valve 14 in a fully opened state, and flows into each indoor unit 3 through the liquid-side refrigerant communication pipe 17*b*. In the indoor unit 3, the refrigerant is depressurized to a predetermined low pressure in the indoor expansion valve 15, further exchanges heat with the indoor air in the indoor heat exchanger 16, and becomes evaporated. Then, the indoor air that is cooled by evaporation of the refrigerant is blown out to a room by an indoor fan (not shown) and cools the room. In addition, the refrigerant evaporated and gasified in the indoor heat exchanger 16 returns to the outdoor unit 2 passing through the gas-side refrigerant communication pipe 17*a* and is sucked into the compressor 11.

On the other hand, during heating operation, the four way switching valve 12 is held in a state shown by dashed lined in FIG. 1. A high-temperature high-pressure gas refrigerant discharged from the compressor 11 flows into the indoor heat exchanger 16 of each indoor unit 3 via the four way switching valve 12, exchanges its heat with the indoor air, and becomes condensed/liquefied. The indoor air heated by condensation of the refrigerant is blown out to the room by the indoor fan and heats the room. The refrigerant liquefied in the indoor heat exchanger 16 returns to the outdoor unit 2 from the indoor expansion valve 15 in a fully opened state through the liquid-side refrigerant communication pipe 17*b*. The refrigerant that returned to the outdoor unit 2 is depressurized to a predetermined pressure in the outdoor expansion valve 14, further exchanges its heat with the outdoor air in the outdoor heat exchanger 13, and becomes evaporated. Then, the refrigerant evaporated and gasified in the outdoor heat exchanger 13 is sucked into the compressor 11 via the four way switching valve 12.

<Structure of Outdoor Unit>

Figure 2:
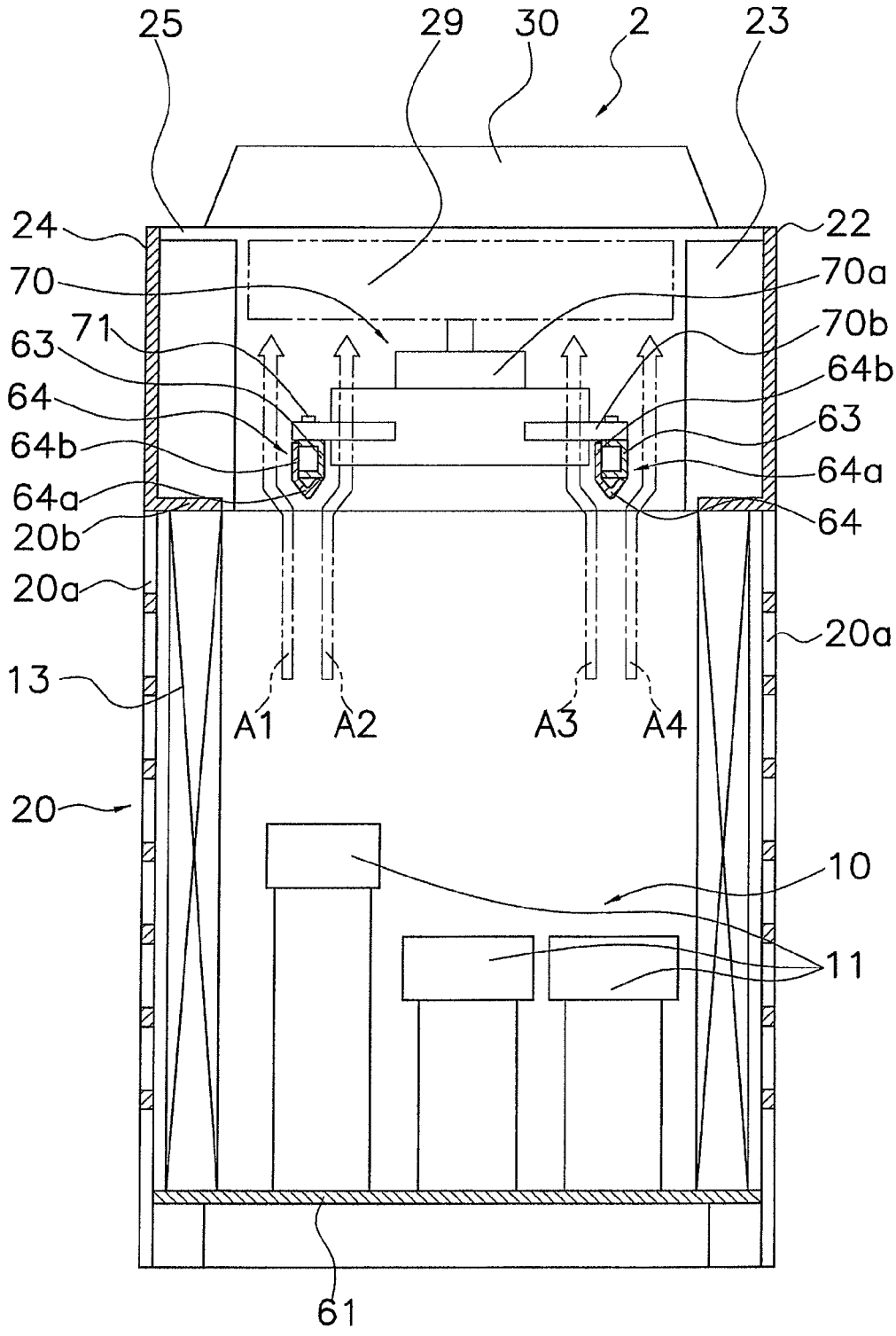
FIG. 2 is an internal structure diagram of an outdoor unit according to an embodiment of the present invention.

Next, the outdoor unit 2 is described with reference to FIGS. 2 through 4. FIG. 2 is a longitudinal cross-sectional view showing the inside structure of the outdoor unit 2, and FIG. 3 is an external perspective view of the outdoor unit 2 with some components removed.

Figure 3:
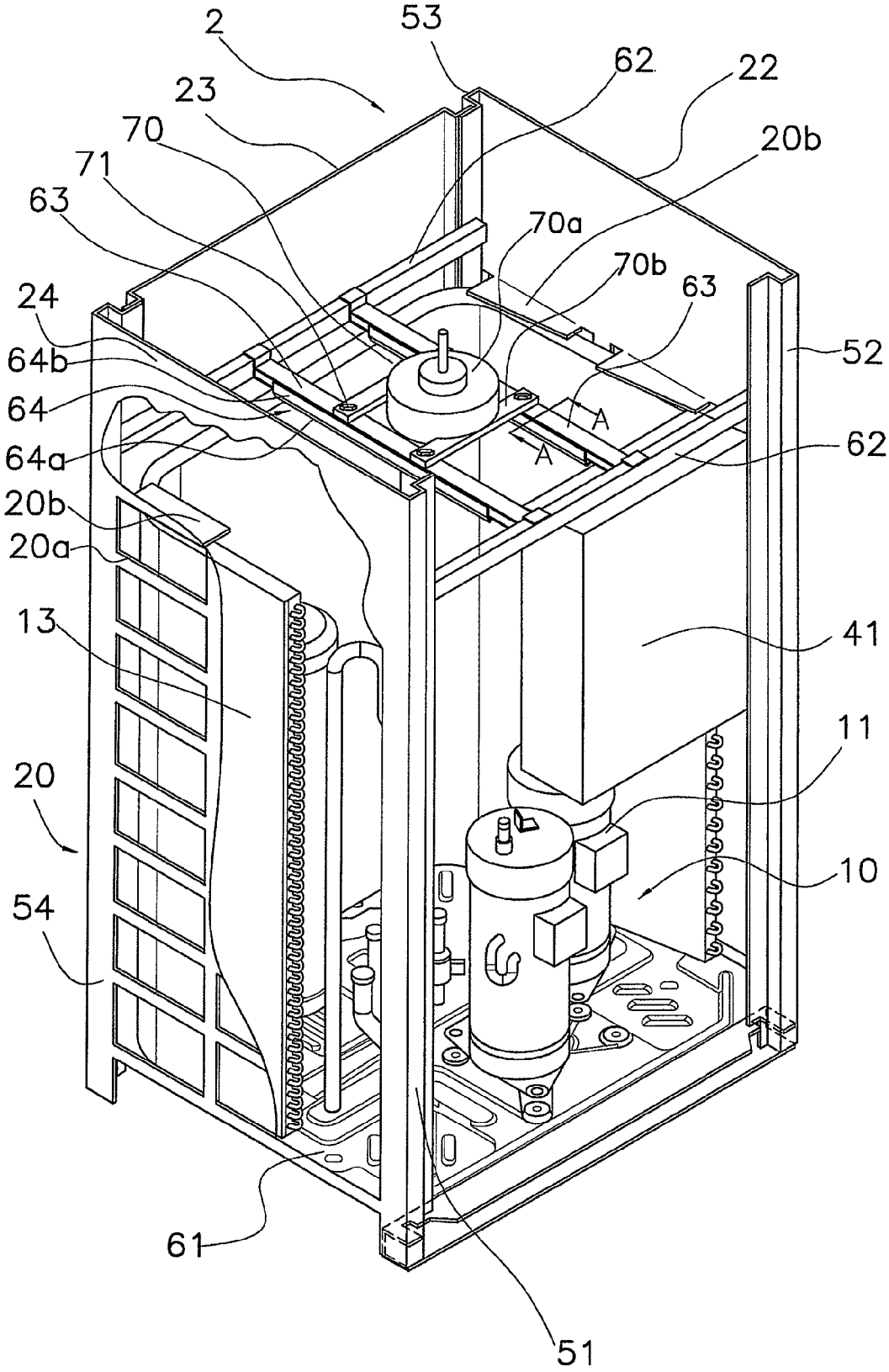
FIG. 3 is an external perspective view of an outdoor unit according to an embodiment of the present invention with some components removed from the outdoor unit.

As shown in FIGS. 2 and 3, the outdoor unit 2 includes a case 20 and an outdoor side portion of the refrigerant circuit 10. The outdoor side portion of the refrigerant circuit 10 includes the compressor 11, the outdoor heat exchanger 13, and the like. The case 20 is formed in a substantially rectangular parallelepiped shape by a front panel 21, a right side panel 22, a back panel 23, a left side panel 24, a top panel 25, and a bottom panel 61.

The compressor 11 and the outdoor heat exchanger 13 are disposed on the bottom panel 61. In this embodiment, the outdoor heat exchanger 13 is disposed along the each inner surface of the right side panel 22, the back panel 23, and the left side panel 24.

The front panel 21 is fixed to support pillars 51, 52 respectively integrally formed at end portions of the side panels 22, 24 (described later) by screw tightening. The back panel 23 is fixed to support pillars 53, 54 respectively integrally formed at other end portions of the side panels 22, 24 (described later) by screw tightening. The back panel 23 has an opening (not shown) used for air introduction in an area where the back panel 23 faces against the outdoor heat exchanger 13, and a protection wire mesh (not shown) is attached to the opening.

The right side panel 22 and the left side panel 24 include a plurality of ventilation portions 20*a* as air introduction ports, and a shape of each ventilation portion 20*a* is a quadrangular hole. In this embodiment, each of the side panels 22, 24 has a total of 16 ventilation portions 20*a* (2 rows by 8 columns). The top side of the ventilation portion 20*a* on the highest row is positioned higher than the uppermost part of the outdoor heat exchanger 13 in the vertical direction, and the bottom side of the ventilation portion 20*a* on the lowest row is positioned approximately at the same height as the lowermost part of the outdoor heat exchanger 13 in the vertical direction.

Note that a plate member 20*b* is formed so as to extend from the top side of the ventilation portion 20*a* on two highest rows toward the inside of the case 20. When the case 20 is assembled, the plate member 20*b* is positioned at the upper side of the top end of the outdoor heat exchanger 13, and covers the gaps between the outdoor heat exchanger 13 and each of the side panels 22, 24. This structure is to suppress air sucked in from the ventilation portions 20*a* from flowing around to a fan 29 passing through the gaps without passing through the outdoor heat exchanger 13. The plate member 20*b* fulfils the function as a resistance plate against the airflow.

The top panel 25 has a circular opening formed at the center, and the fan 29 is freely rotatably disposed at the upper portion of the case 20 including this opening. The circumference of the fan 29 is surrounded by a bellmouth 29*a*. A soft steel wire fan cover 30 formed in a grid shape is attached to the upper side of the top panel 25 so as to cover the circular opening. The fan 29 is driven by a motor 70 disposed therebelow.

A control box 41 is disposed at a position closer to the front panel 21, at the upper portion in the case 20, and the inside of the control box 41 includes a control board that controls the operation of the air conditioner 1.

A support beam 62 is a member for supporting a motor support table 63 (later described). There are two support beams 62; one support beam 62 on the front panel 21 side and another support beam 62 on the back panel 23 side. The support beam 62 on the front panel 21 side is located at the upper portion of the case 20, and the both ends thereof are fixed to the support pillars 51, 52. The support beam 62 on the back panel 23 side is located at the upper portion of the case 20, and the both ends thereof are fixed to the support pillars 53, 54.

The motor support table 63 is a member for fixing the motor 70 thereto. Two motor support tables 63 are disposed side by side with a space therebetween. Each of the two motor support tables 63 is configured such that one end is supported by the support beam 62 on the front panel 21 side and the other end is supported by the support beam 62 on the back panel 23 side.

The motor 70 includes a motor main body 70*a* and a fixing portion 70*b*. The motor main body 70*a* is a drive source for rotation, and the fixing portion 70*b* is a member for fixing the motor main body 70*a* to the two motor support tables 63. The position where the fixing portion 70*b* of the motor 70 is fixed to the motor support table 63 varies depending on the model. There are a model in which the fixing portion 70*b* is fixed substantially in the center of the motor support table 63 and a model in which the fixing portion 70*b* is fixed closer to the back of the motor support table 63 (closer to the back panel 23). In this embodiment, the fixing portion 70*b* of the motor 70 is positioned substantially in the center of the two motor support tables 63, and is tightened to the motor support tables 63 with a screw 71. Rectifying members 64 are attached below the motor support tables 63, covering the lower portions of the motor support tables 63.

<Structure of Motor Support Table and Rectifying Member in Outdoor Unit>

Figure 4:
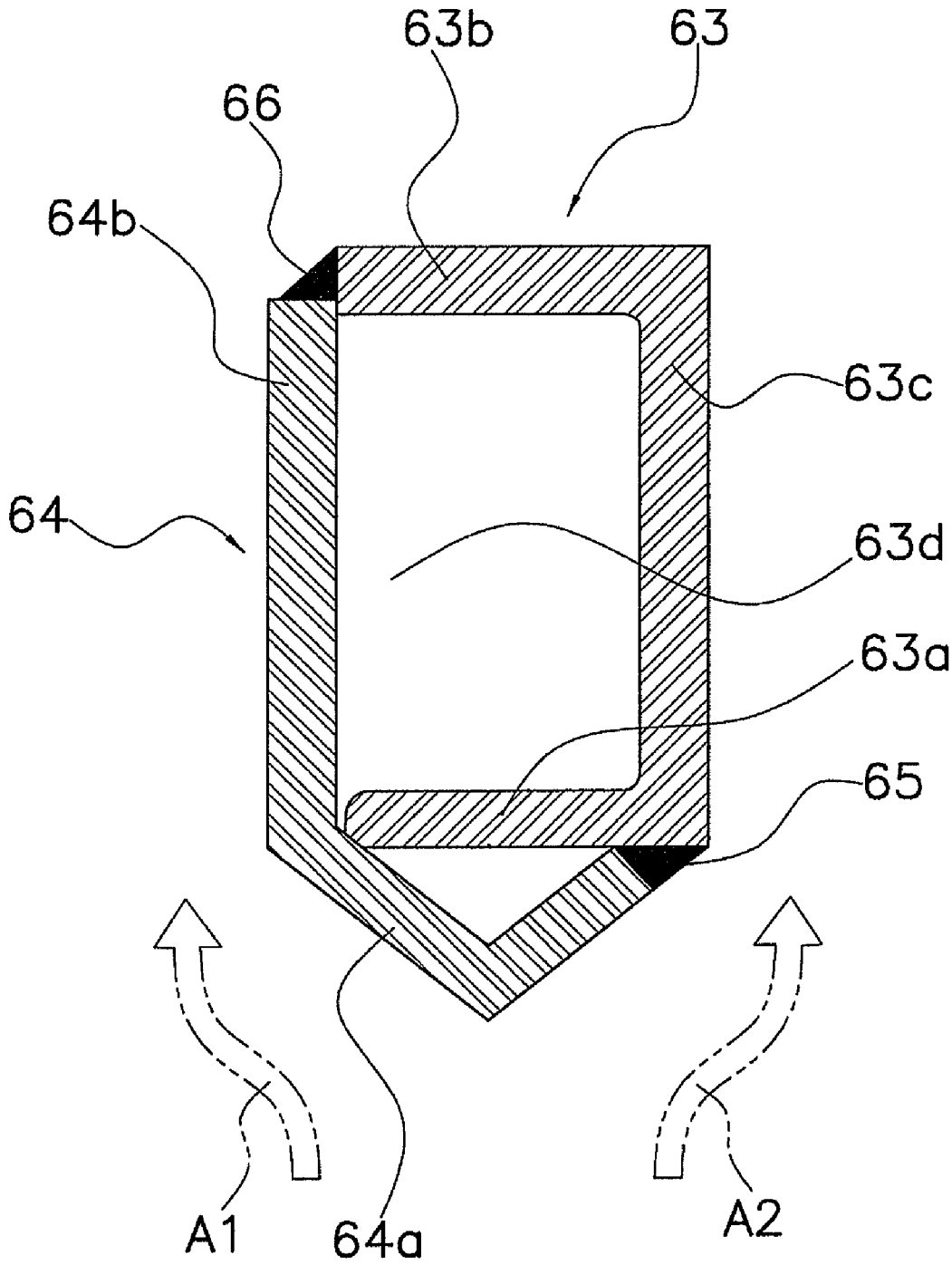
FIG. 4 is a cross-sectional view taken along line A-A in FIG. 3, showing the placement of a motor support table and a rectifying member according to a first embodiment.

FIG. 4 is a cross-sectional view showing the placement of the motor support table 63 and the rectifying member 64. As shown in FIG. 4, the motor support table 63 needs to be highly rigid in order to fix the motor 70, which is a heavy object, thereto. Therefore, the cross-sectional shape is formed in an angular U-shape by a first plate 63*a*, a second plate 63*b*, and a third plate 63*c*. The first plate 63*a* is positioned on the upstream side of airflows A1 and A2, the second plate 63*b* is positioned on the downstream side of the airflows A1 and A2, and the third plate 63*c* is positioned between the first plate 63*a* and the second plate 63*b*. Note that an opening 63*d* is an entrance of the space surrounded by the first plate 63*a*, the second plate 63*b*, and the third plate 63*c*. With the motor support table 63 in this embodiment, the first plate 63*a*, the second plate 63*b*, and the third plate 63*c* are integrally formed by bending a zinc steel plate having a thickness of 2.3 mm.

The rectifying member 64 includes a deflecting portion 64*a* and a guide portion 64*b*. The deflecting portion 64*a* covers the first plate 63*a* of the motor support table 63, and the guide portion 64*b* covers the opening 63*d* of the motor support table 63. The deflecting portion 64*a* is a rod-like member formed such that the cross-sectional shape thereof is triangular, and a vertex of the triangle faces toward the upstream side of the airflows A1 and A2. Note that the cross-sectional shape of the deflecting portion 64*a* is not limited to triangular: it will suffice if the area where the airflows A1 and A2 reflect on the surface orthogonal to the direction of the airflows A1 and A2 from the upstream side to the downstream side gradually increases in the direction of the airflows A1 and A2 from the upstream side to the downstream. For example, shapes such as a circular arc shape, a steeple shape are suitable. A steeple shape having a small air resistance is preferable.

The guide portion 64*b* of the rectifying member 64 extends from an end portion of the deflecting portion 64*a* in parallel to the rotation axis of the motor 70. Note that the above described end portion of the deflecting portion 64*a* refers to the end portion on the downstream side of the airflows A1 and A2. In addition, the guide portion 64*b* of the rectifying member 64 faces against the opening 63*d* so as to cover the opening 63*d* of the motor support table 63. With the rectifying member in this embodiment, the deflecting portion 64*a* and the guide portion 64*b* are integrally formed by bending a zinc steel plate having a thickness of 1 mm.

In addition, in this embodiment, the first plate 63*a* of the motor support table 63 and the deflecting portion 64*a* of the rectifying member 64 are connected by welding. A first welding position 65 is a contact point between an end portion on the third plate 63*c* side of the first plate 63*a* and an end portion of the deflecting portion 64*a* on the downstream side of the airflow. A second welding position 66 is a contact point between an end portion on the opening 63*d* side of the second plate 63*b* of the motor support table 63 and an end portion of the guide portion 64*b* on the downstream side of the airflow.

<Function of Rectifying Member in Outdoor Unit>

In FIG. 2, as the motor 70 rotates the fan 29, air is sucked in from the ventilation portions 20*a* on the side panels 22, 24 and an opening (not shown) in the back panel 23. The air sucked in becomes airflow, passes through the outdoor heat exchanger 13, and rises toward the fan 29. However, the airflow that flowed toward the motor support table 63 is deflected by the deflecting portion 64*a* of the rectifying member 64 so as to avoid the motor support table 63. Then the airflow deflected by each deflecting portion 64*a* is returned by the guide portion 64*b* back in the direction in which the airflow was flowing before being deflected.

Supposedly, if the airflow was maintained in the deflected direction, the airflow would be sucked into the fan 29 at a predetermined angle with respect to the rotation axis of the fan 29. The airflow sucked in parallel to the rotation axis of the fan 29 and the airflow sucked in at a predetermined angle with respect to the rotation axis of the fan 29 would interfere with the fan 29, generating a noise that is a combination of various types of interference noises, which would sound like an abnormal noise. However, the direction of the airflow is returned by the guide portion 64*b* back in the direction in which the airflow was flowing before being deflected. Thereby, the directions of the airflow flowing into the fan 29 are substantially integrated in the direction parallel to the rotation axis of the fan 29. Therefore, the interference noise between the fan and the airflow becomes more monotonous than when the directions of the airflow flowing into the fan are not integrated, and thus the generation of abnormal noise is suppressed.

The airflow sucked into the fan 29 is discharged to the outside of the outdoor unit 2 via the bellmouth 29*a*.

<Characteristics>

With this outdoor unit 2 of the air conditioner, the motor support table 63 is formed such that the cross-sectional shape is formed in an angular U-shape by the first plate 63*a*, the second plate 63*b*, and the third plate 63*c*. The first plate 63*a* is positioned on the upstream side of the airflows A1 and A2, the second plate 63*b* is positioned on the downstream side of the airflows A1 and A2, and the third plate 63*c* is positioned between the first plate 63*a* and the second plate 63*b*. The entrance of the space surrounded by the first plate 63*a*, the second plate 63*b*, and the third plate 63*c* is the opening 63*d*. Each motor support table 63 is disposed with the rectifying member 64 that deflects the airflow flowing from the upstream side of the airflow in a predetermined direction. Each rectifying member 64 includes the deflecting portion 64*a* and the guide portion 64*b*. The cross-sectional shape of the deflecting portion 64*a* is triangular. The deflecting portion 64*a* is disposed below the first plate 63*a*, with its vertex of the triangle facing toward the downstream side of the airflow. In other words, with the deflecting portion 64*a*, the area where the airflow reflects on the surface orthogonal to the direction of the airflow from the upstream side to the downstream side gradually increases in the direction of the airflow from the upstream side to the downstream side. On the other hand, the guide portion 64*b* extends from the end portion of the deflecting portion 64*a* on the downstream side of the airflow in a direction substantially parallel to the rotation axis of the motor 70, and generally covers the opening 63*d*. The airflow that rises through the outdoor heat exchanger 13 is deflected by the deflecting portion 64*a* of each rectifying member 64 and flows avoiding the motor support tables 63. Then the airflow deflected by the deflecting portion 64*a* is guided by each guide portion 64*b* back in the direction in which the airflow was flowing before being deflected.

Consequently, the airflow does not directly hit the motor support tables 63. Thus, the resistance against the airflow is reduced and the wind whistling sound is also reduced. In addition, because the opening 63*d* is covered, generation of a vortex caused by the entrance of the airflow is substantially eliminated, preventing the generation of vibration noise due to the vortex. Further, the directions of the airflow passing through the motor support tables 63 and flowing into the fan 29 are integrated substantially in the same direction. Therefore, the interference noise between the fan and the airflow becomes more monotonous than when the directions of the airflow flowing into the fan are not integrated, and thus the generation of abnormal noise is suppressed.

As a result, the noise is reduced compared to the conventional outside unit of an air conditioner as described in Patent Document 1 (Japanese Patent Application Publication No. 2004-37007). Because the noise is reduced, it is possible to increase the rotation speed of the fan 29, and in such a case, the performance of the air conditioner is improved due to an increase in the air volume.

Second Embodiment

Next, an outdoor unit of an air conditioner according to a second embodiment of the present invention is described with reference to FIGS. 5 through 7. Note that, as for the structure and operation of the air conditioner and the outdoor unit, the descriptions of the portions same as those of the first embodiment are omitted.

In the first embodiment, the motor support table and the rectifying member are connected by welding. However, it is not necessarily limited thereto. For example, they may be connected by screw tightening.

Figure 5:
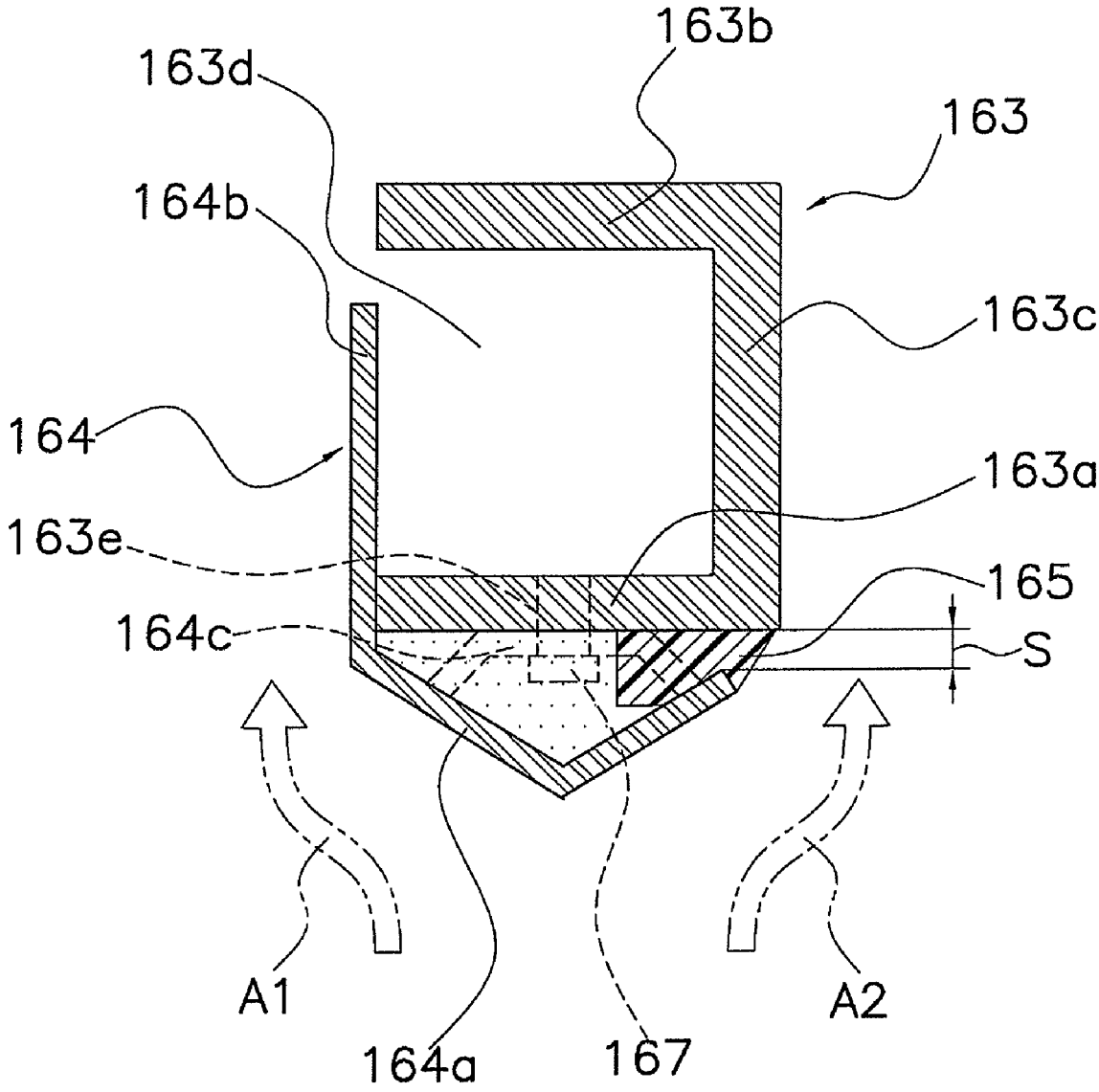
FIG. 5 is a cross-sectional view taken along line A-A in FIG. 3, showing the placement of a motor support table and a rectifying member according to a second embodiment.

FIG. 5 is a cross-sectional view showing the placement of a motor support table 163 and a rectifying member 164. FIG. 6 is a perspective view showing the placement of the motor support table 163 and the rectifying member 164. FIG. 7 is an exploded perspective view showing the placement of the motor support table 163 and the rectifying member 164.

<Structure of Motor Support Table>

Figure 6:
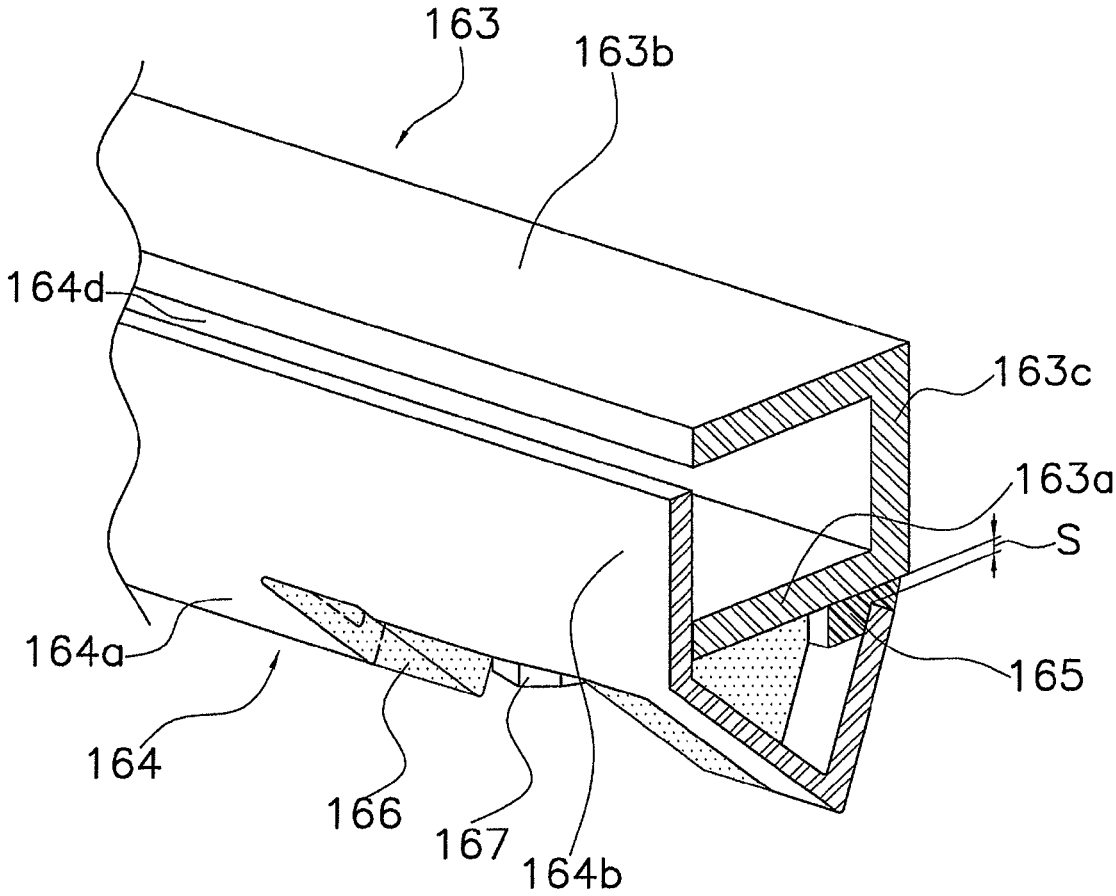
FIG. 6 is a perspective view showing the placement of the motor support table and the rectifying member according to the second embodiment.
Figure 7:
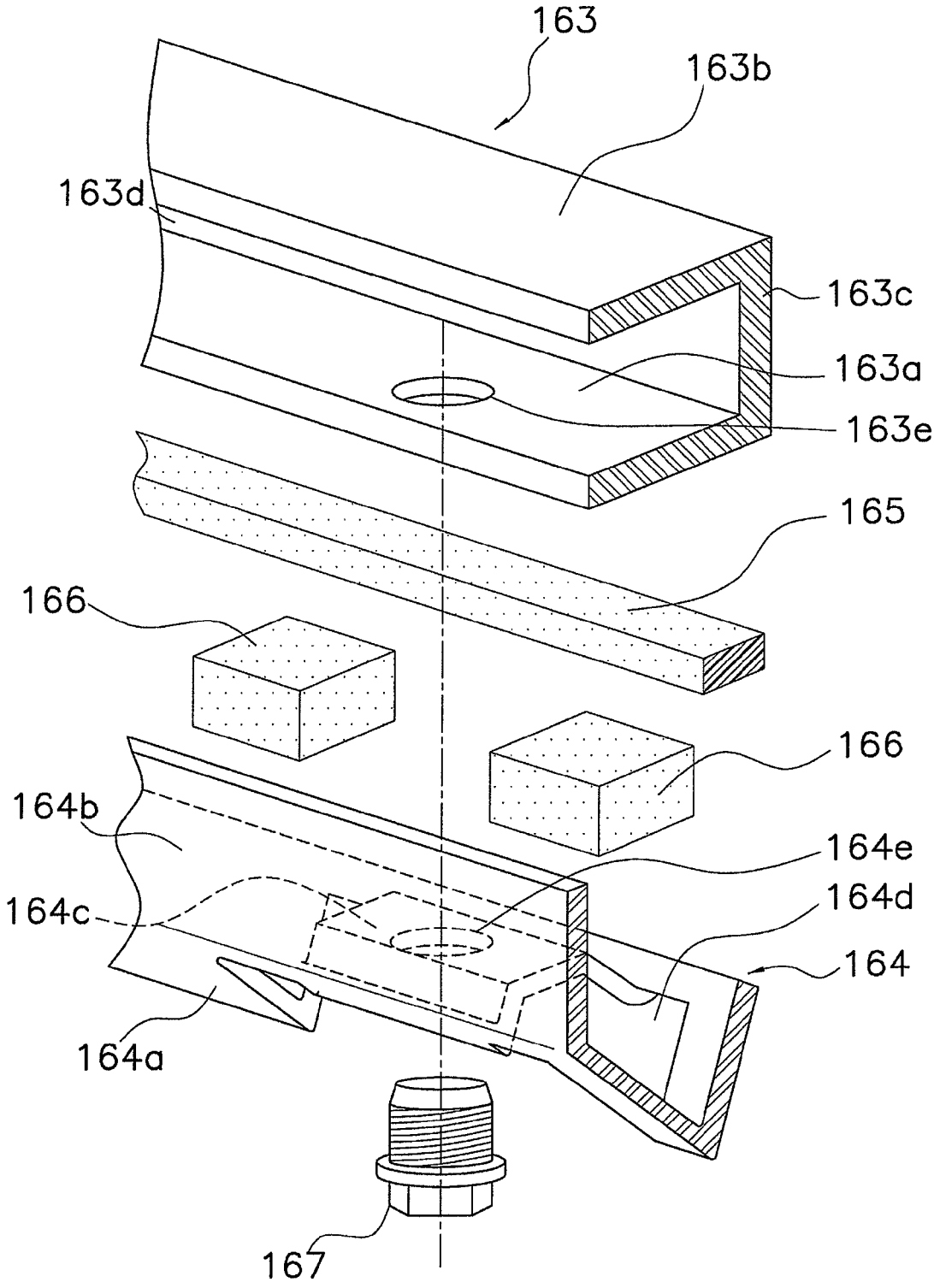
FIG. 7 is an exploded perspective view showing the placement of the motor support table and the rectifying member according to the second embodiment.

As shown in FIGS. 5 and 6, the motor support table 163 is formed such that the cross-sectional shape thereof is formed in an angular U-shape by a first plate 163*a*, a second plate 163*b*, and a third plate 163*c*. The first plate 163*a* is positioned on the upstream side of the airflows A1 and A2, the second plate 163*b* is positioned on the downstream side of the airflows A1 and A2, and the third plate 163*c* is positioned between the first plate 163*a* and the second plate 163*b*. Note that an opening 163*d* is an entrance of the space surrounded by the first plate 163*a*, the second plate 163*b*, and the third plate 163*c*.

<Structure of Rectifying Member>

As shown in FIGS. 5 and 6, the rectifying member 164 includes a deflecting portion 164*a* and a guide portion 164*b*. The deflecting portion 164*a* covers the first plate 163*a* of the motor support table 163. The guide portion 164*b* of the rectifying member 164 extends from an end portion of the deflecting portion 164*a* in parallel to the rotation axis of the motor 70. Note that the above described end portion of the deflecting portion 164*a* refers to the end portion on the downstream side of the airflows A1 and A2. The guide portion 164*b* of the rectifying member 164 faces against the opening 163*d* so as to partially cover the opening 163*d* of the motor support table 163.

The motor support table 163 and the rectifying member 164 are tightened to each other by a screw 167. As shown in FIG. 7, the first plate 163*a* of the motor support table 163 is provided with a screw hole 163*e* to be threaded by the screw 167. The deflecting portion 164*a* of the rectifying member 164 includes a screw washer 164*c*, with which the head of the screw 167 is in contact, formed at a portion corresponding to the screw hole 163*e* of the motor support table 163. In this embodiment, first, a slit 164*d* is formed by cutting out so as to be adjacent to an area where the screw washer 164*c* is to be formed. Subsequently, the area where the screw washer 164*c* is to be formed is pushed out in a direction closer to the first plate 163*a* of the motor support table 163, and the screw washer 164*c* is formed. Lastly, a screw hole 164*e* to be threaded by the screw 167 is formed by punching at the center of the screw washer 164*c*.

<Structure of Sealing Member>

As shown in FIGS. 5 and 6, when the motor support table 163 and the rectifying member 164 are tightened to each other, a gap S is formed between the first plate 163*a* of the motor support table 163 and an end portion of the deflecting portion 164*a* of the rectifying member 164. The gap S is important in terms of prevention of interference between the first plate 163*a* of the motor support table 163 and the end portion of the deflecting portion 164*a* of the rectifying member 164. In this embodiment, the dimension of the gap S is set to be 1 mm.

At the same time, when the airflow passes through the inside of this gap S, it causes the generation of the wind whistling sound, so that a band-like sealing member 165 is arranged in the gap S in order to prevent the airflow from passing through the gap S. In this embodiment, the sealing member 165 uses a thermoplastic resin having high elasticity such as polyurethane for the base material, and includes an adhesive tape at least on one side. In addition, the entire length of the sealing member 165 is set to be substantially same as the entire length of the rectifying member 164, and the thickness dimension of the sealing member 165 is set to be 3 mm. The sealing member 165 is adhered, in advance, to a position where the gap S is to be formed. When the motor support table 163 and the rectifying member 164 are tightened to each other, the sealing member 165 is compressed by the first plate 163*a* of the motor support table 163 and an edge at the end portion of the deflecting portion 164*a* of the rectifying member 164. Thereby, the gap S is completely covered.

In addition, each slit 164*d* at both ends of the screw washer 164*c* is also provided with a sealing member 166. In this embodiment, the sealing member 166 uses a thermoplastic resin having high elasticity such as polyurethane for the base material, and includes an adhesive tape at least on one side. The sealing member 166 is adhered, in advance, so as to completely cover the slit 164*d*, with the both ends of the screw washer 164*c* as reference positions. When the motor support table 163 and the rectifying member 164 are tightened to each other, the sealing member 166 is sandwiched between the first plate 163*a* of the motor support table 163 and the deflecting portion 164*a* of the rectifying member 164 and compressed. The compressed sealing member 166 is pushed out to the opening of each slit 164*d*, and thereby the slit 164*d* is completely covered by the sealing member 166.

Even when the airflow flows into the space surrounded by the first plate 163*a* of each motor support table 163 and the deflecting portion 164*a* of each rectifying member 164, the airflow cannot flow out from the slit 164*d* because the sealing member 166 is arranged. Therefore, the wind whistling sound is prevented from being generated.

As described above, when the motor support table and the rectifying member according to this embodiment are used, the motor support table and the rectifying member are connected by screw tightening which is a method of work that can be done at a relatively low cost. In addition, the gap that causes the wind whistling sound is generally covered.

<Characteristics>

With this outdoor unit 2 of the air conditioner, the gap S is formed between the first plate 163*a* of the motor support table 163 and the end portion of the deflecting portion 164*a* of the rectifying member 164. This gap S is provided with the belt-like sealing member 165. The entire length of the sealing member 165 is set to be substantially same as the entire length of the rectifying member 164. The sealing member 165 is adhered, in advance, to a position where the gap S is to be formed. When the motor support table 163 and the rectifying member 164 are tightened to each other, the sealing member 165 is compressed by the first plate 163*a* of the motor support table 163 and the end portion of the deflecting portion 164*a* of the rectifying member 164. Further, each slit 164*d* at both ends of the screw washer 164*c* is also provided with the sealing member 166. The sealing member 166 is adhered, in advance, so as to completely cover each slit 164*d* at the both ends of the screw washer 164*c*. When the motor support table 163 and the rectifying member 164 are tightened to each other, the sealing member 166 is sandwiched between the first plate 163*a* of the motor support table 163 and the deflecting portion 164*a* of the rectifying member 164, compressed, and pushed out to the opening of each slit 164*d*. Therefore, the slit 164*d* is covered by the sealing member 166.

Accordingly, the motor support tables 163 and the rectifying members 164 are connected by screw tightening which is a method of work that can be done at a relatively low cost. In addition, the gap that causes the wind whistling sound is generally covered.

Other Embodiment

The outdoor unit of an air conditioner of the present invention has thus far been described. However, the specific structure is not limited to the above described embodiments, and various changes and modifications can be made herein without departing from the scope of the invention.

For example, in the above embodiment, the motor support tables and the rectifying members are separately formed. However, the motor support tables and the rectifying members may be integrally formed.

Industrial Applicability

As described above, according to the present invention, a reduction in noise caused by airflow can be achieved, so that the present invention is useful to an outdoor unit of an air conditioner that aims to provide low noise and high performance.

What is claimed is:

1. An outdoor unit of an air conditioner comprising:

a heat exchanger;

a fan configured to move air on the heat exchanger to promote heat exchange between a refrigerant and air;

a motor operatively coupled to the fan to drive the fan;

a motor support table supporting the motor; and a rectifying member configured to deflect air flowing toward the motor support table in a predetermined direction, the motor support table including a first plate positioned on an upstream side of airflow, a second plate positioned on a downstream side of the airflow, and a third plate positioned between the first plate and the second plate to form an angular U-shaped cross-sectional shape, and the rectifying member including a deflecting portion covering the first plate of the motor support table such that an area where the airflow reflects on a surface orthogonal to a direction of the airflow from the upstream side to the downstream side gradually increases in the direction of the airflow from the upstream side to the downstream side, and a guide portion extending in parallel to a rotation axis of the motor and facing an opening of the motor support table that is an entrance to a space surrounded by the first plate, the second plate, and the third plate.

2. The outdoor unit according to claim 1, wherein the deflecting portion has a triangular cross-sectional shape.

3. The outdoor unit according to claim 1, wherein the rectifying member faces against the opening of the motor support table so as to at least partially cover the opening.

4. The outdoor unit according to claim 1, further comprising a sealing member provided in a gap between the motor support table and the rectifying member to suppress air from passing therethrough.

5. The outdoor unit of an air conditioner according to claim 4, wherein the sealing member is compressed between the motor support table and the rectifying member.

* * * * *